US009140136B2

(12) United States Patent
Corcoran et al.

(10) Patent No.: US 9,140,136 B2
(45) Date of Patent: Sep. 22, 2015

(54) STRESS-RELIEVED WIRE SEAL ASSEMBLY FOR GAS TURBINE ENGINES

(75) Inventors: Kevin L. Corcoran, Middletown, CT (US); Kimberly Pash Boyington, Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 587 days.

(21) Appl. No.: 13/485,491

(22) Filed: May 31, 2012

(65) Prior Publication Data

US 2013/0323049 A1 Dec. 5, 2013

(51) Int. Cl.

| | |
|---|---|
| ***F01D 5/30*** | (2006.01) |
| ***F01D 25/00*** | (2006.01) |
| ***F01D 11/00*** | (2006.01) |

(52) U.S. Cl.

CPC ..... *F01D 25/00* (2013.01); *F01D 5/303* (2013.01); *F01D 11/006* (2013.01); *Y10T 29/49297* (2015.01)

(58) Field of Classification Search

CPC ... F01D 11/006; F01D 11/003; F01D 11/005; F01D 5/303; F01D 5/3038; F01D 5/32

USPC ..... 416/215–218, 248, 219 R, 220 R, 221

See application file for complete search history.

(56) References Cited

U.S. PATENT DOCUMENTS

| | | | | |
|---|---|---|---|---|
| 4,280,795 | A | 7/1981 | Trousdell | |
| 4,349,318 | A | 9/1982 | Libertini et al. | |
| 4,432,555 | A | 2/1984 | Langley | |
| 4,730,983 | A | 3/1988 | Naudet et al. | |
| 4,872,810 | A | 10/1989 | Brown et al. | |
| 4,875,830 | A * | 10/1989 | Trousdell et al. | 416/215 |
| 4,878,811 | A | 11/1989 | Jorgensen | |
| 5,078,576 | A | 1/1992 | Hayton | |
| 5,256,035 | A | 10/1993 | Norris et al. | |
| 5,302,086 | A | 4/1994 | Kulesa et al. | |
| 5,332,358 | A | 7/1994 | Hemmelgarn et al. | |
| 5,445,499 | A | 8/1995 | Charbonnel | |
| 5,954,477 | A | 9/1999 | Balsdon | |
| 6,086,329 | A | 7/2000 | Tomita et al. | |
| 6,375,429 | B1 * | 4/2002 | Halila et al. | 416/193 A |

(Continued)

FOREIGN PATENT DOCUMENTS

| | | |
|---|---|---|
| EP | 1 236 337 A1 | 9/1987 |
| GB | 2 194 000 A | 2/1988 |

(Continued)

OTHER PUBLICATIONS

International Search Report and Written Opinion from PCT Application Serial No. PCT/US2013/043370; dated Aug. 24, 2013, 13 pages.

*Primary Examiner* — Dwayne J White
*Assistant Examiner* — William Grigos
(74) *Attorney, Agent, or Firm* — Kinney & Lange, P.A.

(57) ABSTRACT

A sealing assembly for use in a gas turbine engine having a disk arranged relative to an axis, the assembly including a circumferential groove defined in the disk and an annular wire seal positioned at least partially within the groove. The groove includes a first sidewall, a base portion adjoining the first sidewall, and a second sidewall adjoining the base portion opposite the first sidewall, wherein the second sidewall is angled in a range greater than 0° and less than 90° with respect to the axis.

18 Claims, 3 Drawing Sheets

(56) References Cited

U.S. PATENT DOCUMENTS

| | | | | |
|---|---|---|---|---|
| 6,533,550 | B1 | 3/2003 | Mills | |
| 6,565,322 | B1 | 5/2003 | Lieser et al. | |
| 6,682,307 | B1 | 1/2004 | Tiemann | |
| 6,832,892 | B2 | 12/2004 | Murphy et al. | |
| 6,939,106 | B2 | 9/2005 | Murphy et al. | |
| 7,080,974 | B2 | 7/2006 | Lejars et al. | |
| 7,238,008 | B2 | 7/2007 | Bobo et al. | |
| 7,244,105 | B2 | 7/2007 | Moeller | |
| 7,306,433 | B2 | 12/2007 | Klingels et al. | |
| 7,334,331 | B2 | 2/2008 | Bouchard et al. | |
| 7,552,590 | B2 | 6/2009 | Drevs et al. | |
| 7,708,529 | B2 | 5/2010 | Klingels | |
| 7,722,314 | B2 | 5/2010 | Burdgick | |
| 7,942,635 | B1 | 5/2011 | Murray | |
| 7,972,113 | B1 | 7/2011 | Davies | |
| 8,038,403 | B2 * | 10/2011 | Lejars et al. | 416/215 |
| 8,893,381 | B2 | 11/2014 | Noe et al. | |
| 2004/0086387 | A1 | 5/2004 | Fitts et al. | |
| 2007/0014667 | A1 | 1/2007 | Pickens et al. | |
| 2007/0183894 | A1 | 8/2007 | Lejars et al. | |
| 2009/0053064 | A1 | 2/2009 | Ress, Jr. | |
| 2011/0116933 | A1 | 5/2011 | Aiello | |
| 2011/0176923 | A1 | 7/2011 | Haffner | |
| 2011/0200441 | A1 | 8/2011 | Blatchford | |
| 2011/0255973 | A1 | 10/2011 | Borufka et al. | |
| 2012/0195743 | A1 | 8/2012 | Walunj et al. | |
| 2012/0202405 | A1 | 8/2012 | Saunders et al. | |
| 2012/0235366 | A1 | 9/2012 | Walunj et al. | |
| 2012/0263580 | A1 | 10/2012 | Shukla et al. | |

FOREIGN PATENT DOCUMENTS

| | | | |
|---|---|---|---|
| GB | 2 221 724 | A | 2/1990 |
| JP | 10-184307 | A | 7/1998 |

* cited by examiner

STRESS-RELIEVED WIRE SEAL ASSEMBLY FOR GAS TURBINE ENGINES

BACKGROUND

The present invention relates to seals and more particularly to seals for use with gas turbine engines.

Gas turbine engines include airfoils, such as blades and vanes, arranged in cascade configurations. These airfoils can be arranged in compressor or turbine sections of the engine. The airfoils can include a root (e.g., dovetail shaped root) that allows retention of the airfoil in a mounting structure, such as a rotor disk having one or more blade retention slots. For instance, a single circumferential rotor disk slot or a plurality of generally axial slots can be provided for airfoil retention. Many such airfoils include platforms that define a portion of an endwall or flowpath boundary adjacent to a working portion of the airfoil. However, gaps or spaces remain between airfoil platforms and the mounting structure, which is generally a necessity to enable assembly of the airfoils to the mounting structure. Fluid (e.g., air) leakage can include the escape of fluid from a primary flowpath, leading to undesirable pressure loss. Wire seals positioned between compressor rotor disks and blade platforms are known as a mechanism to provide under-platform sealing. These wire seals help reduce leakage of fluid between in a generally forward-aft or axial direction.

It is desired to provide an improved wire seal assembly.

SUMMARY

A sealing assembly for use in a gas turbine engine having a disk arranged relative to an axis, the assembly including a circumferential groove defined in the disk and an annular wire seal positioned at least partially within the groove. The groove includes a first sidewall, a base portion adjoining the first sidewall, and a second sidewall adjoining the base portion opposite the first sidewall, wherein the second sidewall is angled in a range greater than 0° and less than 90° with respect to the axis.

Figure 1:
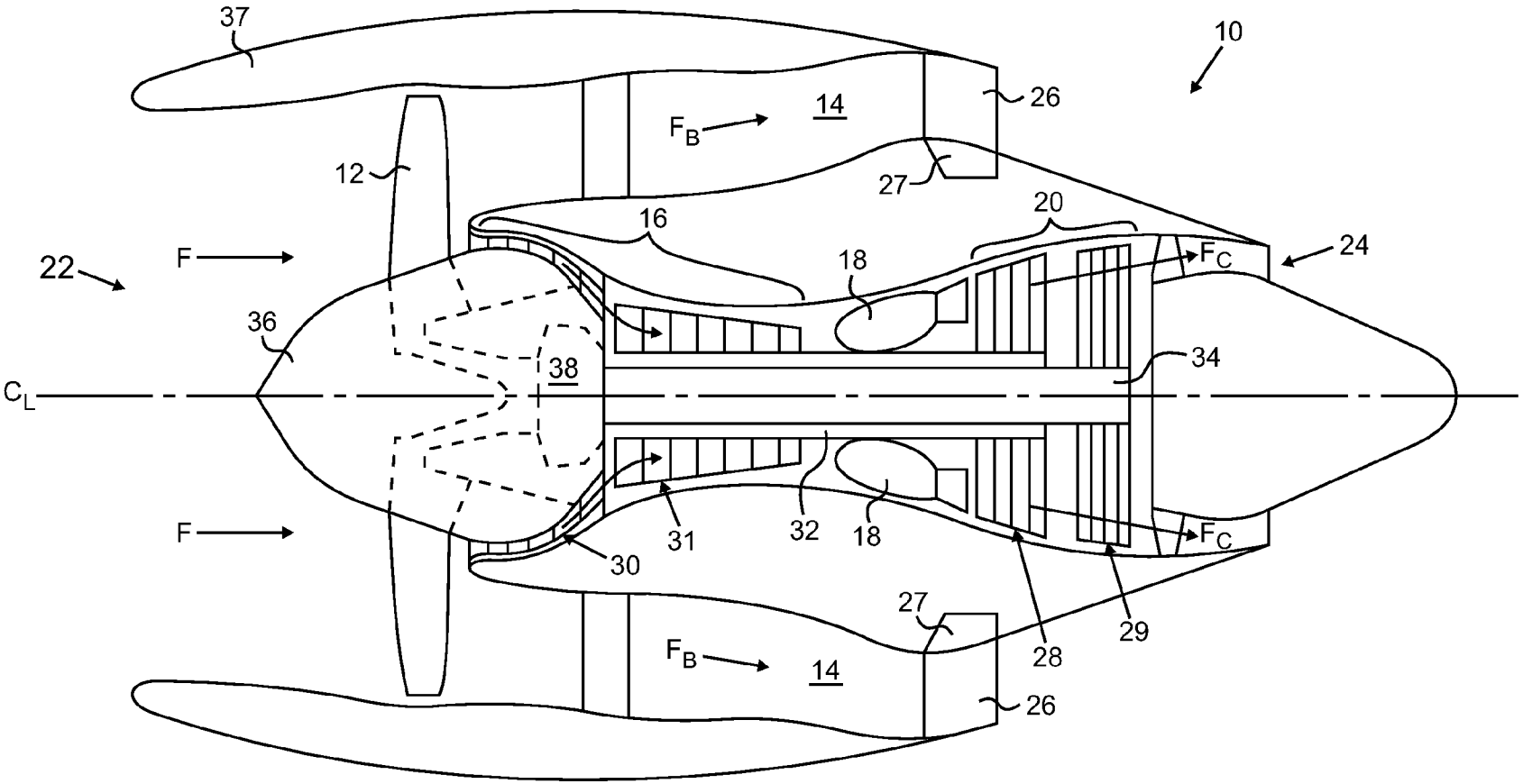
FIG. 1 is a schematic cross-sectional view of a gas turbine engine.

While the above-identified drawing figures set forth at least one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In general, the present invention provides a new configuration and geometry for a wire seal groove for a disk or other structure of a gas turbine engine. Prior art wire seal grooves had purely radially-oriented U-shapes (i.e., having a rounded base with radially-oriented planar sidewalls). A wire seal groove according to the present invention can still open in a radially outward direction but can now further include an angled or skewed sidewall at least at a downstream (i.e., aft) side, which essentially eliminates material of the disk at the angled or skewed sidewall of the groove that would have been present in prior art designs. An upstream boundary of the wire seal groove can be vertically oriented (e.g., at approximately 90° with respect to an engine centerline axis), while a downstream boundary can generally be angled (e.g., at <90° with respect to the engine centerline axis) with a gently curving transition to the adjacent surface. The resultant groove still provides a volume to accept a split ring wire seal (which can expand radially outward beyond the groove), while simultaneously retaining the wire seal to reduce a risk of migration during operation. The angled portion can help provide stress-relief, such as to reduce hoop stress or other stress modes. The wire seal groove can be located on an upstream (forward) rim of the rotor disk, but could be positioned elsewhere in alternative embodiments. Furthermore, in embodiments in which the disk has a load slot for loading airfoil roots into a circumferential retention slot, the wire seal groove can be positioned to avoid intersection with the load slot.

FIG. 1 is a schematic cross-sectional view of an embodiment of a gas turbine engine 10. The illustrated embodiment of the engine 10 shows a turbofan configuration, though persons of ordinary skill in the art will appreciate that other configurations are possible in further embodiments. The gas turbine engine 10 includes a fan section 12, a bypass duct 14, a turbine core that includes a compressor section 16, a combustor section 18 and a turbine section 20, which are arranged between an upstream inlet 22 and a downstream exhaust outlet 24. An airflow F can enter the engine 10 via inlet 22 and can be divided into a bypass flow $F_B$ and a core flow $F_C$. The bypass flow $F_B$ can pass through the bypass duct 14, generating thrust, and the core flow $F_C$ passes along a primary flowpath through the compressor section 16, the combustor section 18 and the turbine section 20.

A variable area nozzle 26 can be positioned in bypass duct 14 in order to regulate a bypass flow $F_B$ with respect to a core flow $F_C$, in response to adjustment by one or more actuators 27. Adjustment of the variable area nozzle 26 allows the turbofan 10 to control or limit a temperature of the core flow $F_C$, including during times of peak thrust demand.

The turbine section 20 can include a high-pressure turbine (HPT) section 28 and a low-pressure turbine (LPT) section 29. The compressor section 16 can include a low pressure compressor (LPC) or boost section 30 and a high pressure compressor (HPC) section 31. The compressor 16 and turbine 20 sections can each include a number of stages of airfoils, which can be arranged as alternating cascades of rotating blades and non-rotating vanes (or stators). The HPT section 28 is coupled to the HPC 31 via a HPT shaft 32, forming a high pressure spool. The LPT section 29 is coupled to the fan section 12 and the LPC 30 via a LPT shaft 34, forming the low pressure or fan spool. The LPT shaft 34 can be coaxially mounted within HPT shaft 32, about centerline axis $C_L$, such that the HPT and LPT spools can rotate independently (i.e., at different speeds).

The fan section 12 is typically mounted to a fan disk or other rotating member, which is driven by the LPT shaft 34. A spinner 36 can be included covering the fan disk to improve aerodynamic performance. As shown in FIG. 1, for example, the fan section 12 is forward-mounted in an engine cowling 37, upstream of the bypass duct 14. In alternative embodiments, the fan section 12 can be aft-mounted in a downstream location, with an alternative coupling configuration. Further, while FIG. 1 illustrates a particular two-spool high-bypass turbofan embodiment of turbine engine 10, this example is provided merely by way of example and not limitation. In other embodiments, the gas turbine engine 10 can be configured either as a low-bypass turbofan or a high-bypass turbofan, in a reverse-flow configuration, the number of spools can vary, etc.

In the particular embodiment of FIG. 1, the fan section 12 is coupled to the LPT shaft 34 via an optional planetary gear or other fan drive geared mechanism 38 (shown in dashed lines), which provides independent speed control. More specifically, the fan drive gear mechanism 38 allows the engine 10 to control the rotational speed of the fan section 12 independently of the high and low spool speeds (that is, independently of HPT shaft 32 and LPT shaft 34), increasing the operational control range for improved engine response and efficiency across an operational envelope.

In operation, compressor 16 compresses incoming air of the core flow $F_C$ for the combustor section 18, where at least a portion of that air is mixed with fuel and ignited to produce hot combustion gas. The combustion gas can exit the combustor section 18 and enter the HPT section 28, which drives the HPT shaft 32 and in turn drives the HPC 31. Partially expanded combustion gas transitions from the HPT section 28 to the LPT section 29, driving the fan section 12 and the LPC 30 via the LPT shaft 34 and, in some embodiments, the fan drive gear mechanism 38. Exhaust gas can exit the engine 10 via exhaust outlet 24.

Figure 2:
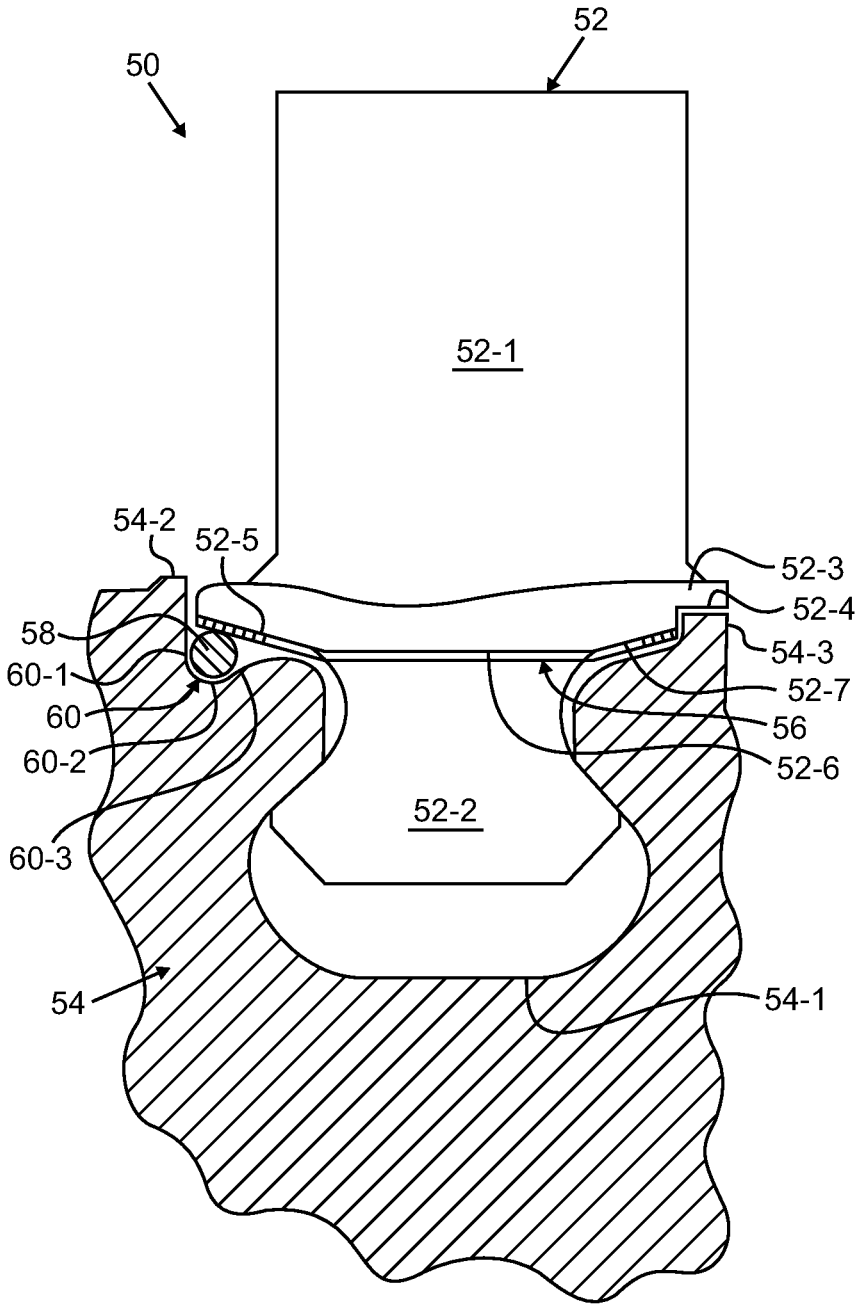
FIG. 2 is a cross-sectional view of a rotor disk assembly with a wire seal assembly according to the present invention.
Figure 3:
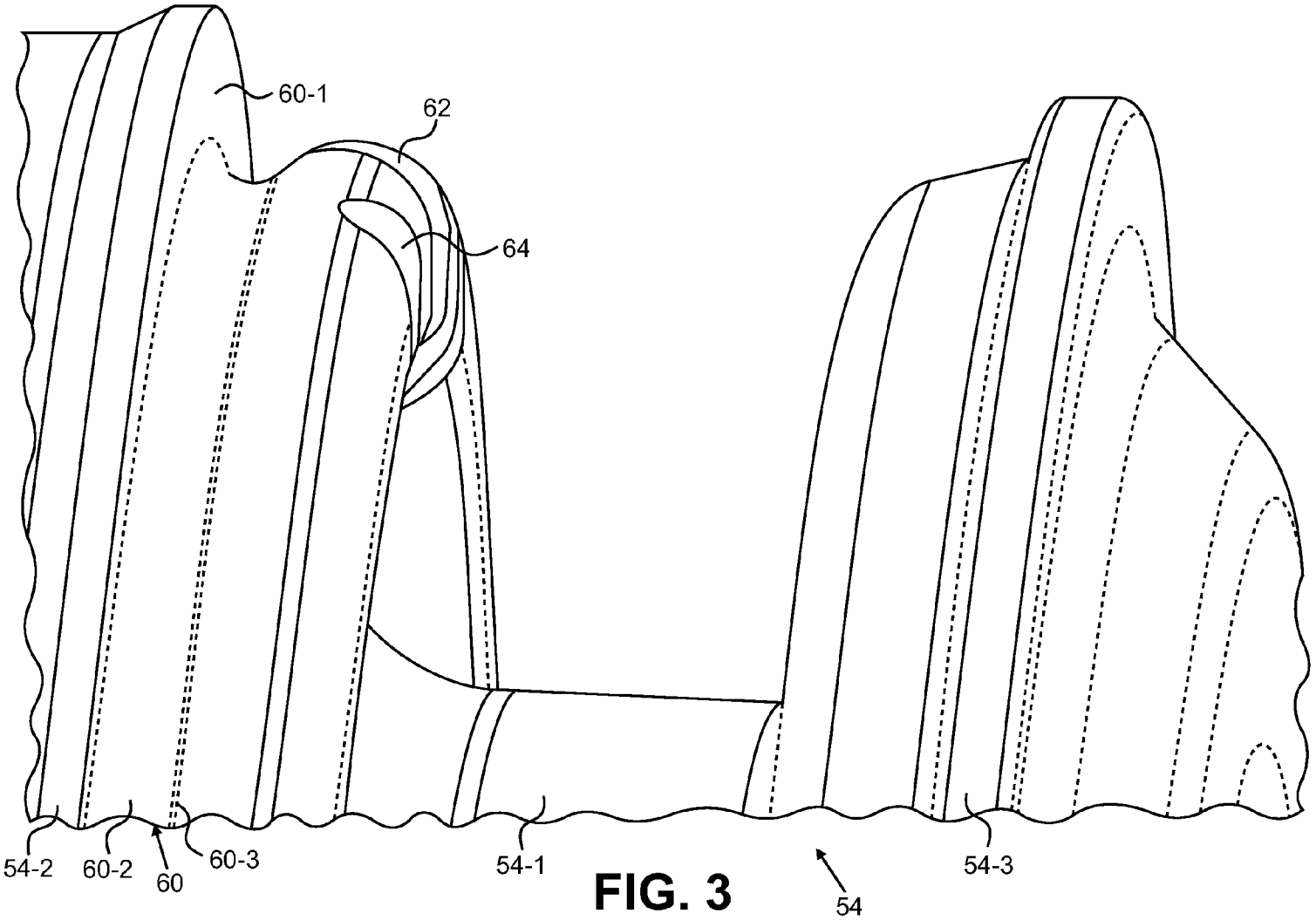
FIG. 3 is a perspective view of the rotor disk of FIG. 2, shown in isolation, with dashed lines shown to help illustrate curved surfaces.

FIG. 2 is a cross-sectional view of a rotor disk assembly 50 that includes airfoils 52 (e.g., rotor blades), a disk 54 (e.g., rotor disk), an optional ladder seal system 56, and a wire seal 58. FIG. 3 is a perspective view of the disk 54, shown in isolation. The rotor disk assembly 50 can be a stage of the high pressure compressor 31, or can be in another section of the engine 10 in further embodiments. It should be noted that in FIG. 2 only one airfoil 52 is visible.

As shown in the illustrated embodiment, each airfoil 52 can include a working portion 52-1, a root 52-2 and a platform 52-3 located between the working portion 52-1 and the root 52-2 (as used herein, the term "root" can also encompass what is sometimes separately referred to as a "shank"). The working portion 52-1 can be positioned to extend into a primary flowpath of the engine 10 to interact with a working fluid (i.e., core flow $F_C$). The root 52-2 can have a dovetail shape or other desired shape to retain the airfoil 52 relative to the disk 54. The platform 52-3 can form a portion of a boundary of the primary flowpath.

At an underside (i.e., radially inner surface, as shown in the illustrated embodiment) of the platform 52-3, a notch 52-4, an upstream angled portion 52-5, a central portion 52-6, and a downstream angled portion 52-7 can be provided.

The disk 54 includes at least one retention slot 54-1, which in the illustrated embodiment is a single circumferentially-extending slot at an outer rim of the disk 54. The slot 54-1 and the root 52-2 can have complementary shapes, allowing the slot 54-1 to radially retain the airfoil 52. As explained further below, a load feature (see FIG. 3) can be formed in the slot 54-1, or other suitable features provided, to facilitate insertion of the root 52-2 into the slot 54-1. Furthermore, a lock feature (see FIG. 3) can be provided in the slot 54-1 to allow engagement of an airfoil lock (not shown) to help secure a cascade of the airfoils 52 in the slot 54-1.

The disk 54 can further include a ramped circumferential ridge 54-2 that extends radially outward from the outer rim on an upstream side of the slot 54-1 (i.e., on an upstream rail). The ridge 54-2 can protrude radially outward at least as far as a flowpath surface (e.g., radially outward surface) of the platform 52-3 of the airfoil 52, and be positioned upstream of a leading edge of the platform 52-3, in order to help reduce flow separation at or near the leading edge of the platform 52-3.

In addition, the disk 54 can further include a circumferentially-extending ridge 54-3 that extends radially outward from the outer rim on a downstream side of the slot 54-1 (i.e., on a downstream rail). The ridge 54-3 can be positioned generally upstream of a trailing edge of the platform 52-3 of the airfoil 52, that is, with a downstream edge of the ridge 54-3 located at or upstream of the trailing edge of the platform 52-3, such that the ridge 54-3 is positioned generally underneath the platform 54-3. The notch 52-4 can be formed in the platform 52-3 immediately upstream of the trailing edge and can have a shape that is complementary to a shape of the ridge 54-3 of the disk 54, with the ridge 54-3 extending into (i.e., radially overlapping with) the notch 52-4. A sealing effect is provided by the notch 52-4 and the ridge 54-3, which together alter the shape of a space between the platform 52-3 and the disk 54. In alternative embodiments, the notch 52-4 and the ridge 54-3 could instead be located at or near a leading edge of the platform 52-3 and an upstream rail of the disk 54, respectively.

The wire seal 58 can be a full hoop (i.e., 360°) split ring, and can be made of a suitable metallic material. In the illustrated embodiment the wire seal 58 has a substantially circular cross-sectional shape. The wire seal 58 is positioned at least partially within a wire seal groove 60 located on the outer rim of the disk 54 that opens radially outwardly to accept the wire seal 58. During operation of the engine 10, the wire seal can expand radially outwardly and rest against the platforms 52-3 of the airfoils 52 (e.g., against the upstream angled portion 52-5) or against the ladder seal system 56, if present. The wire seal can generally provide sealing in an upstream-downstream or axial direction (relative to the centerline axis $C_L$). In the illustrated embodiment, the wire seal 58 and the wire seal groove 60 are both positioned at an upstream rim of the risk 54, that is, upstream or forward of the slot 54-1. In further embodiments, one or more additional wire seals 58 and wire seal grooves 60 can be provided such that wire seals 58 are located on both sides of the slot 54-1. In another embodiment, the wire seal 58 and wire seal groove 60 could be positioned downstream or aft of the slot 54-1 rather than upstream of the slot 54-1. The particular number and location of wire seals 58 and corresponding grooves 60 can vary as desired for particular applications.

The wire seal groove 60 can include an upstream sidewall 60-1, a base 60-2 and a downstream sidewall 60-3. In the illustrated embodiment, the upstream sidewall 60-1 can have a substantially planar, radially-oriented configuration (i.e., at approximately 90° with respect to the centerline axis $C_L$), and can adjoin and form part of a trailing edge of the ramped circumferential ridge 54-2. The base 60-2 adjoins the upstream sidewall 60-1 can have a radially inwardly radiused configuration (e.g., with a radius approximately equal to a radius of the wire seal 58), such that no sharp corners are present between the upstream sidewall 60-1 and the base 60-2. The downstream sidewall 60-3 adjoins the base 60-2 opposite the upstream sidewall 60-1. In the illustrated embodiment, the downstream sidewall 60-3 has an angled or skewed configuration (i.e., at an angle greater than 0° and less than 90° with respect to the centerline axis $C_L$), that generally orients the downstream sidewall 60-3 at a different angle than the upstream sidewall 60-1. In one embodiment, the downstream sidewall 60-3 can be angled in a range of about 0°-50°. The downstream sidewall 60-3 angles away from the base

60-2 in the illustrated embodiment, which essentially eliminates material of the disk 54 and widens and enlarges an open volume of the wire seal groove 60. The particular angle of the downstream sidewall 60-3 can be selected such that wire seal 58 remains axially constrained by the groove 60, though some axially movement is permitted. Axial movement of the wire seal 58 should be limited though to help prevent binding or the formation of leakage paths around the wire seal 58. A smooth curvature can be provided along the downstream sidewall 60-3 such that sharp corners are avoided between the base 60-2 and the retention slot 54-1. The groove 60, including the downstream sidewall 60-3, has substantially the same shape around an entire circumference of the disk 54 in the illustrated embodiment.

As shown in FIG. 3, a load slot 62 and a lock slot 64 can be provided along the retention slot 54-1 in the disk 54. The load slot 62 can facilitate insertion of the roots 52-2 of the airfoils 52 into the retention slot 54-1 of the disk 54. The lock slot 64 can be locate adjacent to the load slot 62, and can provide space for a locking mechanism (e.g., blade lock) that helps retain the airfoils 52 in the retention slot 54-1. Examples of load slots and lock slots are disclosed in commonly-assigned U.S. Pat. App. Pub. No. 2001/0116933. Additional slots extending from the retention slot 54-1 can also be provided as desired for particular applications.

The inventors have discovered that intersection of the wire seal groove 60 and the load slot 62, lock slot 64 or other slot feature can cause undesirable stress concentration. Accordingly, in one embodiment, the wire seal groove 60 can be positioned forward of (i.e., spaced upstream from) the load slot 62 and the lock slot 64 to avoid intersection. Furthermore, the downstream sidewall 60-3 of the wire seal groove 60 can be configured to avoid a leakage path through the load slot 62 due to migration of the wire seal 58 during operation of the engine 10.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal or rotational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A sealing assembly for use in a gas turbine engine having a disk arranged relative to an axis, the assembly including a circumferential groove defined in the disk, and an annular wire seal positioned at least partially within the groove. The groove includes a first sidewall; a base portion adjoining the first sidewall; and a second sidewall adjoining the base portion opposite the first sidewall, wherein the second sidewall is angled in a range greater than 0° and less than 90° with respect to the axis.

The assembly of the preceding paragraph can optionally include, additionally and/or alternatively, any one or more of the following features, configurations and/or additional components:

- the first sidewall can be angled at approximately 90° with respect to the axis;
- the first sidewall can be substantially planar;
- a ramped circumferential ridge that extends radially outward from the disk, wherein the first sidewall adjoins and forms a part of an edge of the ramped circumferential ridge;
- an airfoil retention slot defined in the disk, wherein the circumferential groove is located upstream of the airfoil retention slot;
- a smooth curvature can be provided between the base portion and the airfoil retention slot, including along the second sidewall;
- an airfoil retained by the disk, the airfoil having a platform and a notch at an edge of the platform; and a circumferential ridge extending radially outward from the disk and at least partially into the notch;
- the wire seal can comprise a full hoop split ring having a substantially circular cross-sectional shape; and/or
- a radius of the base portion of the groove can be approximately equal to a cross-sectional radius of the split ring wire seal.

A method of making a sealing assembly for a gas turbine engine includes creating a circumferential groove adjacent in a structure to an airfoil retention slot, wherein the groove is created with a first sidewall, a base portion adjoining the first sidewall, a second sidewall adjoining the base portion opposite the first sidewall, and wherein the second sidewall is angled in a range greater than 0° and less than 90° with respect to an engine axis; and positioning an annular wire seal at least partially within the groove.

The method of the preceding paragraph can optionally include, additionally and/or alternatively, any one or more of the following features and/or additional steps:

- creating a ramped circumferential ridge that extends radially outward from the structure, such that the first sidewall adjoins and forms a part of an edge of the ramped circumferential ridge; and/or
- creating a notch at an edge of a platform of an airfoil; creating a circumferential ridge extending radially outward from the structure adjacent to the airfoil retention slot; and inserting the airfoil into the airfoil retention slot such that the circumferential ridge at least partially extends into the notch.

A sealing assembly for use in a gas turbine engine includes a retention structure arranged relative to an engine axis; an airfoil retention slot defined in the retention structure; an airfoil retained by the airfoil retention slot; a circumferential groove defined in the retention structure adjacent to the airfoil retention slot, and an annular wire seal positioned at least partially within the groove. The groove includes a first sidewall; a base portion adjoining the first sidewall; and a second sidewall adjoining the base portion opposite the first sidewall, wherein the second sidewall is angled in a range greater than 0° and less than 90° with respect to the axis.

The assembly of the preceding paragraph can optionally include, additionally and/or alternatively, any one or more of the following features, configurations and/or additional components:

the first sidewall can be angled at approximately 90° with respect to the axis;

the first sidewall can be substantially planar;

a ramped circumferential ridge that extends radially from the retention structure, wherein the first sidewall adjoins and forms a part of an edge of the ramped circumferential ridge;

the groove can be located upstream of the airfoil retention slot;

a smooth curvature can be provided between the base portion and the airfoil retention slot, including along the second sidewall;

the airfoil can further include a platform and a notch at an edge of the platform, and the retention structure can further include a circumferential ridge extending radially and at least partially into the notch; and/or the wire seal can comprise a full hoop split ring having a substantially circular cross-sectional shape, and a radius of the base portion of the groove can be approximately equal to a cross-sectional radius of the split ring wire seal.

The invention claimed is:

1. A sealing assembly for use in a gas turbine engine having a disk arranged relative to an axis of rotation of the gas turbine engine, the assembly comprising:

a circumferential groove defined in the disk, the groove including:

a first sidewall;

a base portion adjoining the first sidewall; and a second sidewall adjoining the base portion opposite the first sidewall, wherein the second sidewall adjoins the base portion at a location where a concave curvature of the base portion terminates, wherein the second sidewall includes a smooth convex curve, and wherein the entire second sidewall is angled away from the base portion such that the second sidewall is angled in a range greater than 0° and less than 90° with respect to the axis; and an annular wire seal positioned at least partially within the groove.

2. The assembly of claim 1, wherein the first sidewall is angled at approximately 90° with respect to the axis.

3. The assembly of claim 2, wherein the first sidewall is substantially planar.

4. The assembly of claim 1 and further comprising:

a ramped circumferential ridge that extends radially outward from the disk, wherein the first sidewall adjoins and forms a part of an edge of the ramped circumferential ridge.

5. The assembly of claim 1 and further comprising:

an airfoil retention slot defined in the disk, wherein the circumferential groove is located upstream of the airfoil retention slot.

6. The assembly of claim 1 and further comprising:

an airfoil retained by the disk, the airfoil having a platform and a notch at an edge of the platform; and a circumferential ridge extending radially outward from the disk and at least partially into the notch.

7. The assembly of claim 1, wherein the wire seal comprises a full hoop split ring having a substantially circular cross-sectional shape.

8. The assembly of claim 7, wherein a radius of the base portion of the groove is approximately equal to a cross-sectional radius of the split ring wire seal.

9. A method of making a sealing assembly for a gas turbine engine, the method comprising:

creating a circumferential groove adjacent in a structure to an airfoil retention slot, wherein the groove is created with a first sidewall, a base portion adjoining the first sidewall, a second sidewall adjoining the base portion opposite the first sidewall, wherein the second sidewall adjoins the base portion at a location where a concave curvature of the base portion terminates, wherein the second sidewall includes a smooth convex curve, and wherein the entire second sidewall is angled away from the base portion such that the second sidewall is angled in a range greater than 0° and less than 90° with respect to an engine axis of rotation; and positioning an annular wire seal at least partially within the groove.

10. The method of claim 9 and further comprising:

creating a ramped circumferential ridge that extends radially outward from the structure, such that the first sidewall adjoins and forms a part of an edge of the ramped circumferential ridge.

11. The method of claim 9 and further comprising:

creating a notch at an edge of a platform of an airfoil;

creating a circumferential ridge extending radially outward from the structure adjacent to the airfoil retention slot; and inserting the airfoil into the airfoil retention slot such that the circumferential ridge at least partially extends into the notch.

12. A sealing assembly for use in a gas turbine engine, the assembly comprising:

a retention structure arranged relative to an axis of rotation of the gas turbine engine;

an airfoil retention slot defined in the retention structure;

an airfoil retained by the airfoil retention slot;

a circumferential groove defined in the retention structure adjacent to the airfoil retention slot, the groove including:

a first sidewall;

a base portion adjoining the first sidewall; and a second sidewall adjoining the base portion opposite the first sidewall, wherein the second sidewall adjoins the base portion at a location where a concave curvature of the base portion terminates, wherein the second sidewall includes a smooth convex curve, and wherein the entire second sidewall is angled away from the base portion such that the second sidewall is angled in a range greater than 0° and less than 90° with respect to the axis; and an annular wire seal positioned at least partially within the groove.

13. The assembly of claim 12, wherein the first sidewall is angled at approximately 90° with respect to the axis.

14. The assembly of claim 13, wherein the first sidewall is substantially planar.

15. The assembly of claim 12 and further comprising:

a ramped circumferential ridge that extends radially from the retention structure, wherein the first sidewall adjoins and forms a part of an edge of the ramped circumferential ridge.

16. The assembly of claim 12, wherein the groove is located upstream of the airfoil retention slot.

17. The assembly of claim 12, wherein the airfoil further includes a platform and a notch at an edge of the platform, and wherein the retention structure further includes a circumferential ridge extending radially and at least partially into the notch.

18. The assembly of claim 12, wherein the wire seal comprises a full hoop split ring having a substantially circular cross-sectional shape, and wherein a radius of the base portion of the groove is approximately equal to a cross-sectional radius of the split ring wire seal.

* * * * *